United States Patent [19]

Morrison et al.

[11] 4,346,790

[45] Aug. 31, 1982

[54] ARTICULATED CAR BRAKE SYSTEM

[75] Inventors: Robert B. Morrison; James T. Wade; Robert E. Zimmerman, all of Topeka, Kans.

[73] Assignee: Itel Corporation, San Francisco, Calif.

[21] Appl. No.: 225,723

[22] Filed: Jan. 16, 1981

Related U.S. Application Data

[63] Continuation of Ser. No. 969,652, Dec. 15, 1978, abandoned.

[51] Int. Cl.[3] ..... B61D 17/00; B61F 3/12; B61H 13/00

[52] U.S. Cl. ..... 188/47; 74/505; 105/4 R; 188/34; 188/52; 410/65

[58] Field of Search ..... 74/505, 491, 506; 105/4 R, 3; 188/34, 51, 52, 53, 54, 55, 33, 47, 198; 410/65

[56] References Cited

U.S. PATENT DOCUMENTS

| | | | |
|---|---|---|---|
| 460,586 | 10/1891 | Leary | 188/34 |
| 607,920 | 7/1898 | Elliott | 188/47 |
| 1,177,618 | 4/1916 | Gregg | 188/47 |
| 1,459,250 | 6/1923 | Pflager | 105/4 R |
| 1,524,207 | 1/1925 | Pflager | 105/4 R X |
| 2,620,902 | 12/1952 | Wilson | 188/198 |
| 2,622,709 | 12/1952 | Wilson | 74/505 X |
| 3,163,128 | 12/1964 | Enochian | 410/65 |
| 3,184,000 | 5/1965 | Radey | 188/52 |
| 3,294,035 | 12/1966 | Enochian | 410/65 |
| 3,337,011 | 8/1967 | Billeter | 182/52 X |
| 3,420,339 | 1/1969 | Karakashian et al. | 188/47 |
| 3,484,815 | 12/1969 | Tearpock | 188/33 |
| 3,561,284 | 2/1971 | Yates | 74/506 |
| 3,646,604 | 2/1972 | Tack et al. | 105/4 R |
| 3,712,146 | 1/1973 | Sands | 74/491 |
| 3,721,199 | 3/1973 | Hassenauer | 105/4 R X |

*Primary Examiner*—Joseph F. Peters, Jr.
*Assistant Examiner*—Howard Beltran
*Attorney, Agent, or Firm*—Wegner, McCord, Wood & Dalton

[57] ABSTRACT

A handbrake arrangement for railroad freight cars is disclosed that will connect a mechanical handbrake operating mechanism to the brake equipment (brake beams and brake shoes) on 2, 3, or more trucks on the same freight car. It is especially useful on articulated freight cars consisting of multiple units in order to satisfy handbrake power requirements required by industry and Federal regulations, but a similar arrangement may be used on special purpose cars having a multiplicity of trucks. On an articulated car, consisting of a number of units, there is a multiplicity of trucks and because of the size and weight characteristics of the car, it is desirable to connect the handbrake mechanism to a number of the trucks in order to provide adequate handbrake power. A relatively simple mechanical handbrake mechanism for providing adequate braking power to a series of lightweight short articulated interconnected cars consists of a series of rods, levers, and slack adjusters interconnecting two or more trucks to the handbrake operating mechanism.

15 Claims, 16 Drawing Figures

ARTICULATED CAR BRAKE SYSTEM

CROSS-REFERENCE TO RELATED APPLICATION

This application is a continuation of Ser. No. 969,652, filed Dec. 15, 1978, now abandoned.

The multiple truck freight car handbrake arrangement of the present invention is preferably applied to a series of relatively lightweight, short, articulately interconnected cars for transporting trailers or other cargo containers on a railway. The interior cars of the series include a center sill which constitutes a narrow width underframe and a length substantially equal to the length of a car, a pair of end sills connected perpendicularly to the center sill at opposite ends thereof and having a width extending beyond each side of the center sill, support members interconnecting the ends of the end sills with the center sill, and male and female portions of an articulated connector respectively attached to each end of a car. End cars have one end constructed similarly, but are provided with conventional semi-automatic couplings on the other end in place of a portion of the articulated connector. The articulated connectors are mounted on a single conventional railway truck which spans the adjacent ends of interconnected cars and further supports the support members. Special configurations of the cars are provided for use in a trailer-on-flatcar (TOFC) and container-on-flatcar (COFC) environments. Examples of these special configurations are disclosed in Adams et al application Ser. No. 890,984, filed on Mar. 28, 1978, now U.S. Pat. No. 4,233,909, granted Nov. 18, 1980.

GENERAL BACKGROUND OF THE INVENTION

As described in the Adams et al application referred to above, the sharply increased cost of locomotive fuel in the past several years has caused increased efforts in the railroad industry to reduce tare weight of rolling stock, since fuel consumption is related to the gross weight of the shipment (train plus cargo). While reduced weight is an important consideration in any type of shipment, it is especially important in piggyback (highway trailer or container carried on a flatcar, hereinafter TOFC and COFC, respectively) shipments, where the tare weight of the trailer or container is in addition to the tare weight of the flatcar. This "double tare" weight handicaps the rail mode of transportation in its competitive position vis-a-vis highway transportation for containerized cargo, even though the latter is generally considered to be less efficient in its use of fuel.

Piggyback traffic is generally carried on flatcars of 85 to 89 feet, 4 inches in length. These cars can readily handle two trailers or containers 40 feet long or less; however, in recent years, the 45-foot highway trailer has come into popular use and presently constitutes a large percentage of the total production of highway trailers. Two 45-foot trailers cannot be carried on an 89-foot flatcar, and so it often happens that only one 45-foot trailer is carried on an 89-foot car, thereby further reducing the fuel efficiency of the operation.

The construction of longer cars to accommodate two 45-foot trailers or containers to remedy this problem is impossible because the railroad industry through its industry association, the Association of American Railroads (AAR), has placed a length limit of 89 feet, 4 inches on any cars constructed in the future. This length restriction is necessary because of operating problems inherent in long cars having long end overhang (beyond the railway trucks). Typically, the cars tend to pull off curves in conditions of heavy pull and to jack-knife under heavy buff forces. Additionally, the geometry of long cars causes them to track poorly, and with the long end overhang there is a tendency for the air hose connections between cars to separate in operation and cause an emergency application of the train air brakes. Still further, long cars must be made quite heavy in order to support the carried weight which is concentrated at the center of the car where the adjacent ends of the two containers or trailers are supported, thereby adding further construction expense and burdens to the pulling equipment. The arrangements described and claimed in the aforesaid Adams et al application go far in overcoming bulk cargo transportation problems of the kind referred to above. However, ordinary car braking arrangements of the kinds heretofore known in the prior art still leave much to be desired as regard safe and effective braking means for the articulately interconnected cars of the kind described in the aforesaid Adams et al application—and especially with increasing numbers of cars and therefore longer trains.

Accordingly, one object of the present invention is to improve the efficiency and safety of the braking means for such piggyback equipment by providing a unique multiple track handbrake arrangement for a railway car assembly for transporting a number of trailers or containers.

Another object of the invention is to provide an effective handbrake means for a railway car assembly of the piggyback variety for carrying variously sized trailers or containers.

Another object of the invention is to provide a railway car assembly of the piggyback variety having improved handbrake operating characteristics.

Still further and other objects of the invention will become apparent as the description proceeds.

SUMMARY OF THE INVENTION

The foregoing and other objects of the invention are achieved by applying to a railway car assembly, especially of the kind described in Adams et al application Ser. No. 890,894, filed Mar. 28, 1978, the disclosure of which is incorporated herein by reference, a novel handbrake arrangement of the kind more fully described in detail hereinafter. Before proceeding to that detail, however, the railway car assembly itself will first be described as background for showing how the novel handbrake arrangement is to be applied.

The railway car assembly comprises a series of specially designed short skeleton cars semi-permanently connected with an articulated connector. The articulated connector has a male portion attached to one end of the individual car units, which mates with a female portion attached to the end of an adjacent car unit. The female portion of the connector also has a male center plate cast integrally therewith which mates into the center bowl of a conventional freight car truck bolster, through which the car weight is carried into the car truck. The car truck is located so as to span adjacent ends of the interconnected cars, i.e., is common to two adjacent cars.

The outer end of the outer car units in the series is carried by a single axle or conventional twin axle truck in a manner similar to conventional rail freight equipment. A conventional freight car semi-automatic coupler is used at the outer end of the end car units for interconnecting the series of cars with conventional railway equipment, and conventional or end-of-car cushioning devices may be used in combination therewith.

Any number of individual car units may be semi-permanently connected together, although a practical limit for reasons of maintenance, truck capacity, etc., is of the order of six to twelve individual car units per semi-permanently connected section of cars.

Individual car units are constructed with a center sill extending substantially the entire length of a car. Opposite ends of the center sill are attached to respective end sills perpendicularly disposed to the center sill, the end sills having a width extending symmetrically beyond either side of the center sill. Support elements such as arms or gussets interconnect the ends of the end sills with the center sill. The support elements are designed to rest on support bearings affixed to the specially modified bolster of a common truck interconnecting two adjacent car units or to support bearings affixed to the end truck in the case of an end car unit.

The length of the individual articulated car units is just over that of a typical carried trailer or container, e.g., 40 feet or 45 feet. As a result, the weight of the piggyback shipment is concentrated over the railway trucks at the ends of the cars, thus obviating the need for a heavy underframe to support the vertical load and considerably reducing car weight. Cars of differing length, e.g., 40 feet or 45 feet, can be mixed together in the railway car assembly. Further, by doing away with the conventional car deck and merely supplying a short platform at one end of the car units to carry the trailer bogie in a trailer-on-flatcar (TOFC) use or by affixing transverse bolsters to support the container ends in a container-on-flatcar (COFC) use, additional weight is eliminated. An adjustable saddle type platform for carrying a trailer bogie may also be substituted for a fixed platform to accommodate trailers of varying lengths.

Conventional cushioning devices such as pneumatic cushions or draft gears are eliminated at the articulated connections, and the so-called low-deck (28" diameter wheel) freight-car truck is used to further reduce car height and weight.

When the cars are adapted to handle trailer shipments, i.e., TOFC environment, the conventional trailer hitch is placed as near to the end of the car units as possible, which permits the end of the trailer to overhang the next car unit (the trailer king pin being normally located 36 inches back from the front of the trailer). By so doing, the rear platform for carrying the trailer bogie is located ahead of the railway truck at the end of a car. At this location, the trailer bogie platform may be placed at a height below that of the railway truck wheels. In one embodiment of the car, the platform is located 26 inches above a rail, which is approximately 16 inches below the deck height of a conventional flatcar. This construction permits a lowered profile for the carried trailers and reduces the air resistance of the car and lading thereby further reducing the consumption of fuel. The lowered height of the trailer also results in a lower overall center of gravity, with resulting improvement in dynamic operating characteristics.

The car units may be of a length which permits only a small gap (approximately 10") to exist between the piggyback shipments thereby further reducing air resistance and resulting in a further fuel savings. This reduced gap between adjacent trailers and containers also tends to reduce pilferage while the shipment is en route, since it is impossible to open the end door and remove lading in such a narrow space.

The length of the overhang beyond a railway truck center at the outer ends of the end car units is minimal and is generally less than half that of the conventional 89-foot flatcar. There is no overhang at the semi-permanent articulated intermediate connections, i.e., the end of the car unit and the center of the articulated connector are at a coincident location.

The improved riding qualities of the articulated equipment and the absence of severe lateral truck movement eliminates air hose separations occasionally experienced at high speeds in the operation of conventional piggyback flatcar equipment.

In a train of ten 10-articulated-car units, there will be only eleven air hose connections between the locomotive, car sections and caboose car. This compares to fifty-one air hose connections in a train of conventional 89-foot piggyback equipment having the ability to also carry one hundred trailers (the latter in 40' lengths on conventional equipment).

The foregoing description of the articulately interconnected car construction and arrangement is taken largely from the aforesaid Adams et al application, and is included herein for the sake of completeness. The novel handbrake arrangement of the present invention as applied to such an articulately interconnected car construction and arrangement will now be first broadly and later more particularly described.

The handbrake arrangement of the present invention connects a mechanical handbrake operating mechanism to the brake equipment (brake beams and brake shoes) on 2, 3, or more trucks on the same freight car. It is intended primarily for use on articulated interconnected freight cars consisting of multiple units in order to satisfy handbrake power requirements required by industry and Federal regulations, but a similar arrangement may be used on other special purpose cars having a multiplicity of trucks.

On a conventional freight car that has only two trucks, the handbrake operating mechanism may be connected to one or both of the trucks to provide the required braking power. On an articulated interconnected freight car consisting of a number of units, there is a multiplicity of trucks and because of the size and weight characteristics of the car, it is necessary to connect the handbrake mechanism to a number of the trucks in order to provide adequate handbrake power from the point of view of safety and effectiveness.

The present relatively simple mechanical handbrake for providing adequate braking power to a series of lightweight relatively short articulated interconnected cars consists of a series of rods, levers, and slack adjusters interconnecting two or more trucks to the handbrake operating mechanism. The handbrake operating mechanism is connected to the brakes on the second, third and fourth trucks from the handbrake end (B-end) of the articulated car. It is not intended to limit to three the number of trucks whose brakes are connected to the handbrake operating mechanism, since the arrangement may readily be extended to a greater number of trucks if greater braking power is required. In the case of the particular articulated car shown and described herein (and in the aforesaid Adams et al application) by way of example, braking power meeting all normal safety requirements is derived by connecting the handbrake operating mechanism to three trucks.

Additional objects and advantages of the invention will become apparent from the following detailed description thereof with particular reference to the accompanying drawings.

DETAILED DESCRIPTION OF THE INVENTION

Figure 1A:
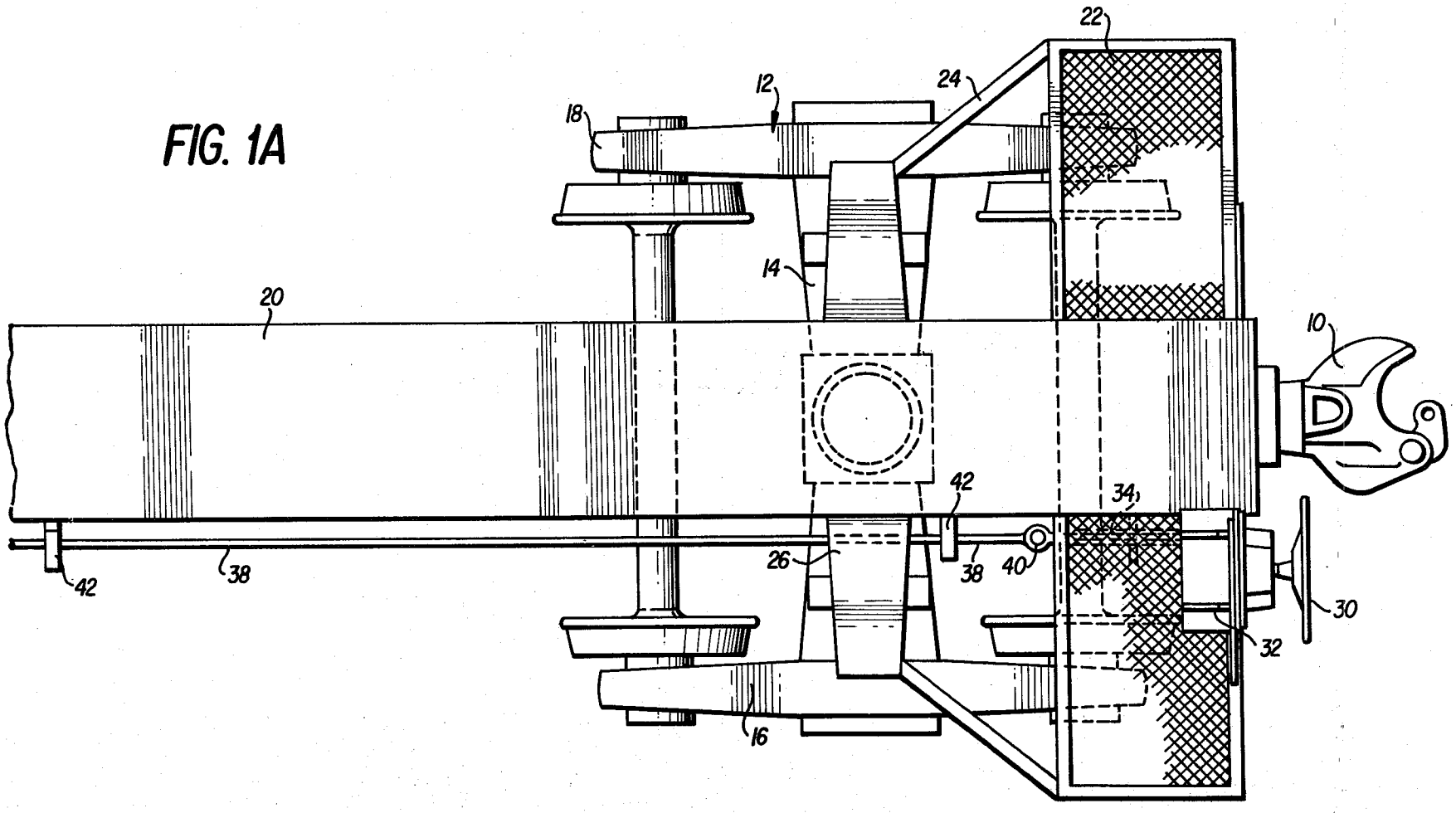
FIG. 1A illustrates in top plan view the end (the "B-end") of one of the end cars of the articulately interconnected cars to which the handbrake arrangement of the present invention is applied.

The handbrake end (the "B-end") of the end car of a typical railway car assembly to which th present invention is preferably applied is illustrated in FIG. 1A. This end car is provided with a conventional semi-automatic coupler 10 and a truck 12 carrying a body bolster 14 between frames 16 and 18 for supporting the center sill 20. A safety platform 22 is supported by a suitable frame 24. A body bolster 26 spans the width of the truck 12 just inboard of the safety platform 22.

Figure 2A:
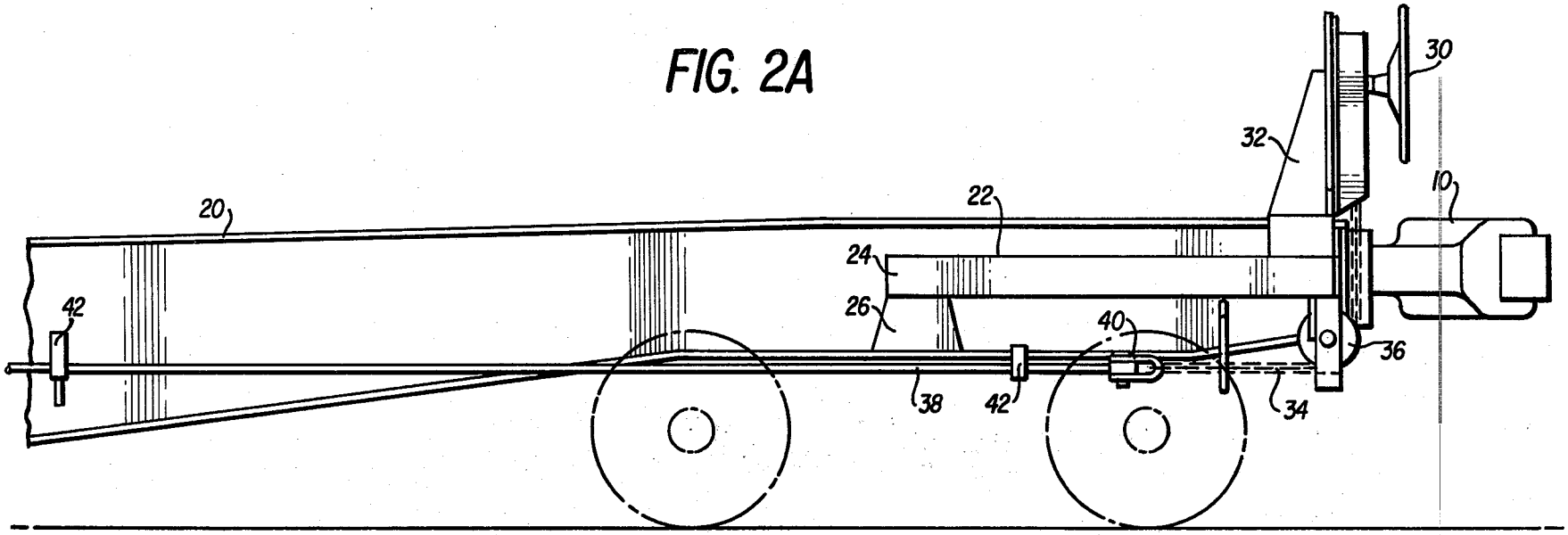
FIG. 2A is a side elevation of one end of an articulated car showing a hand wheel and a chain linkage to the brake rod and lever system.
Figure 4:
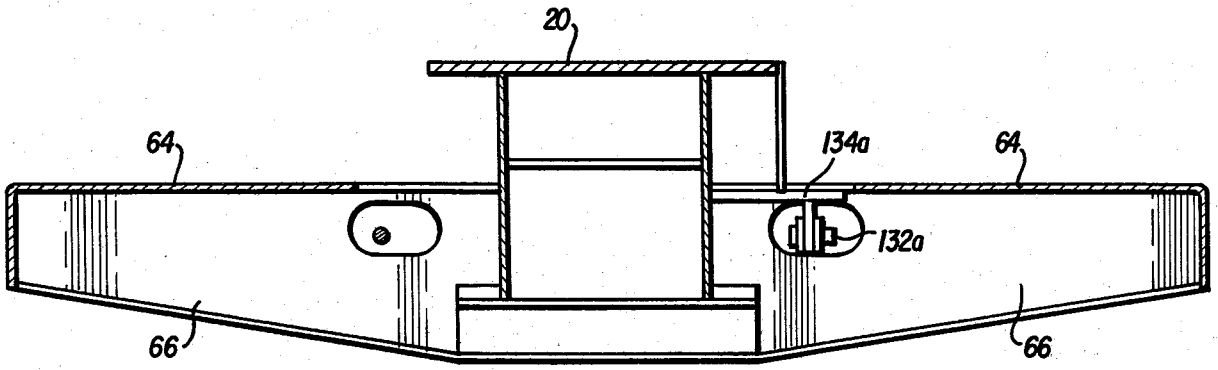
FIG. 4 is a cross-sectional view taken along the line 4—4 of FIG. 1B.
Figure 3:
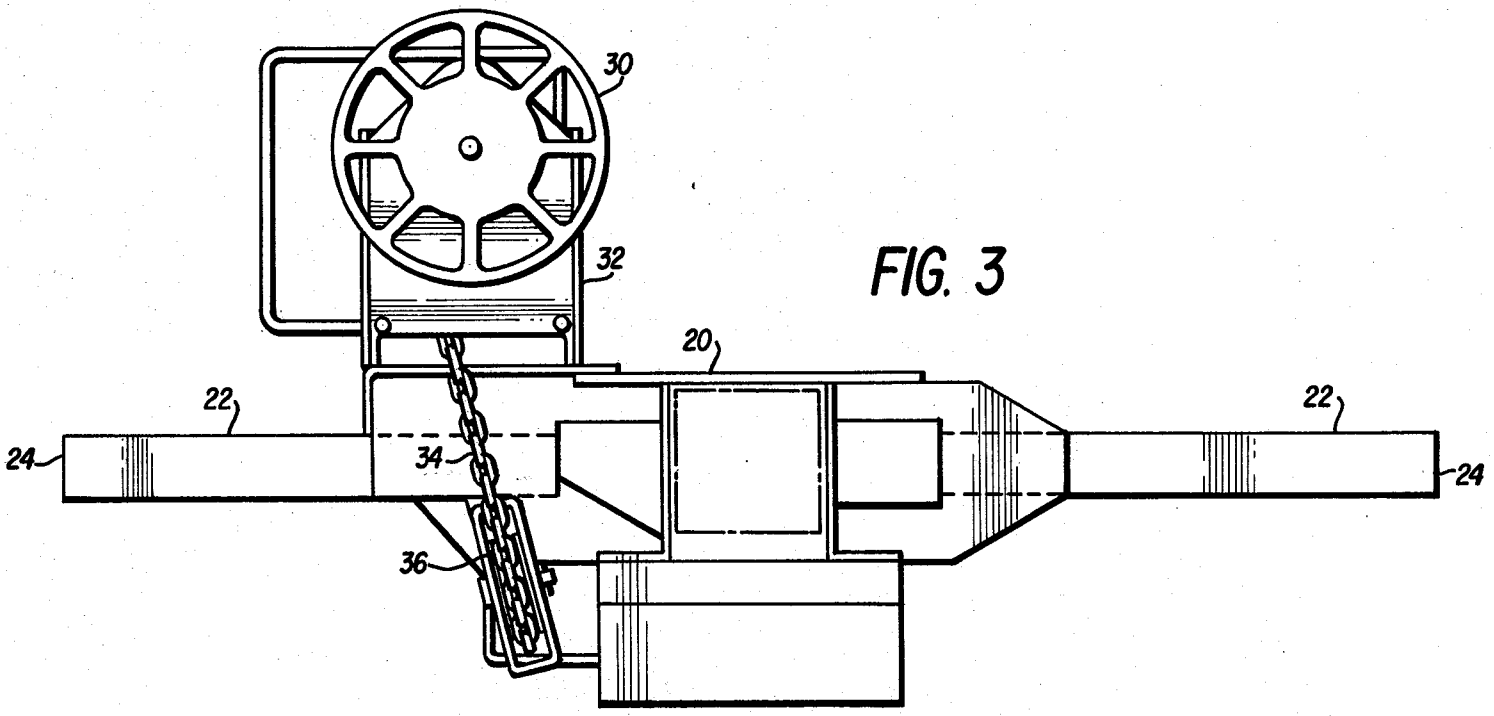
FIG. 3 is an end elevation of the "B" car shown in FIGS. 1A and 2A.
Figure 2C:
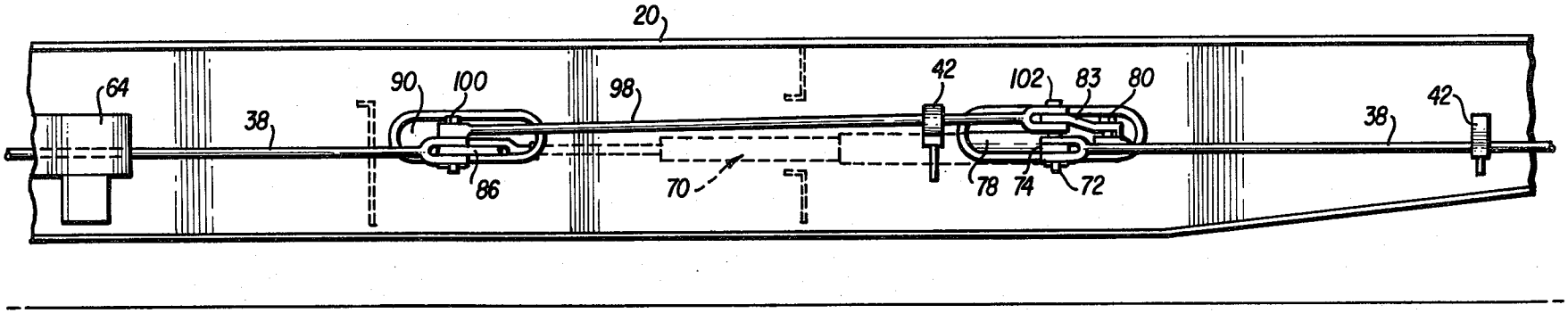
FIG. 2C is a side elevational view of the structure illustrated in FIG. 1C.
Figure 7:
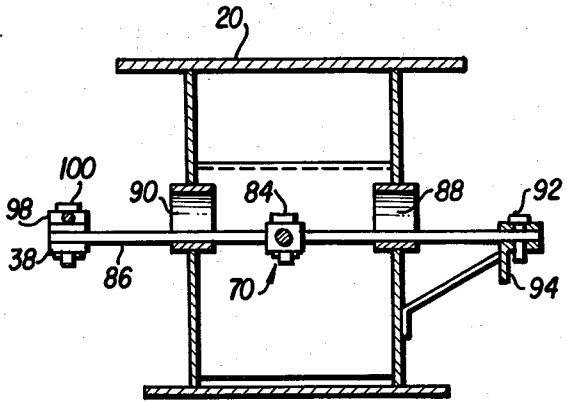
FIG. 7 is a cross-sectional view taken along the line 7—7 of FIG. 1C.

The end of the car is provided with a conventional handbrake, including wheel 30, which is mounted to one side of the center sill 20 and just above the safety platform 22 (see FIGS. 2A and 3). The handbrake is mounted in a vertical bracket 32 and is provided with an enlarged portion or hub (not shown) around which the handbrake chain 34 is wrapped and securely fastened in conventional manner, so that upon rotation of the handbrake wheel 30 in a clockwise direction (as shown in FIG. 3) tension forces are applied to the chain 34. The chain 34 passes around a sheave wheel 36 and a connects to a horizontal brake rod 38 through a conventional clevis 40. The brake rod 38 passes through and is supported by a series of brackets 42 located at suitably spaced points along the center sill and welded or otherwise secured to the center sill 20. These brackets 42 permit the brake rod 38 to move freely in a horizontal direction when the handbrake wheel 30 is actuated.

Figure 1B:
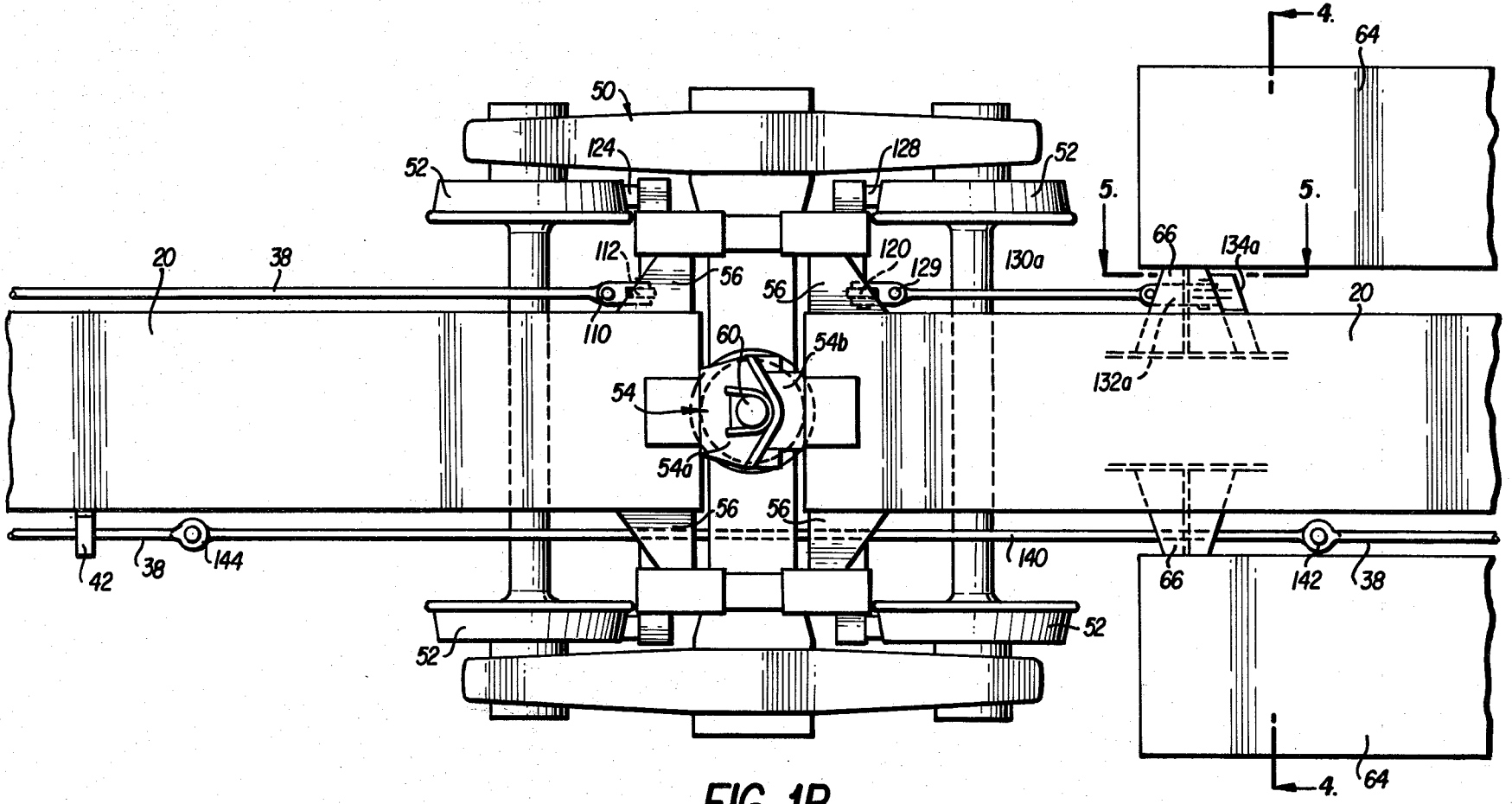
FIG. 1B illustrates in top plan view a railway truck which bridges and supports adjacent ends of two cars connected with an articulated connector, and showing the handbrake arrangement.

Turning now to FIG. 1B, 50 denotes a railway truck that bridges and supports adjacent ends of two cars connected with an articulated connector, and shows the handbrake arrangement by which the braking force is applied to the wheels 52 of truck 50.

The intermediate cars are provided on opposite ends with a male portion **54*b* and a female portion 54*a* of an articulated car coupling 54. The center sills 20 are provided with support gussets 56 which is turn are supported on side support bearings (not shown) which are mounted on the truck 50**.

The articulated connector 54 is of conventional design and arrangement and is illustrated in detail in U.S. Pat. No. 3,646,604 to which reference may be made. Pin 60 locks the male and female portions of the connector together. Trailer loading platforms or bogie supports 64 are attached to the end of the center sill 20 via cross bearing members 66.

Figure 1C:
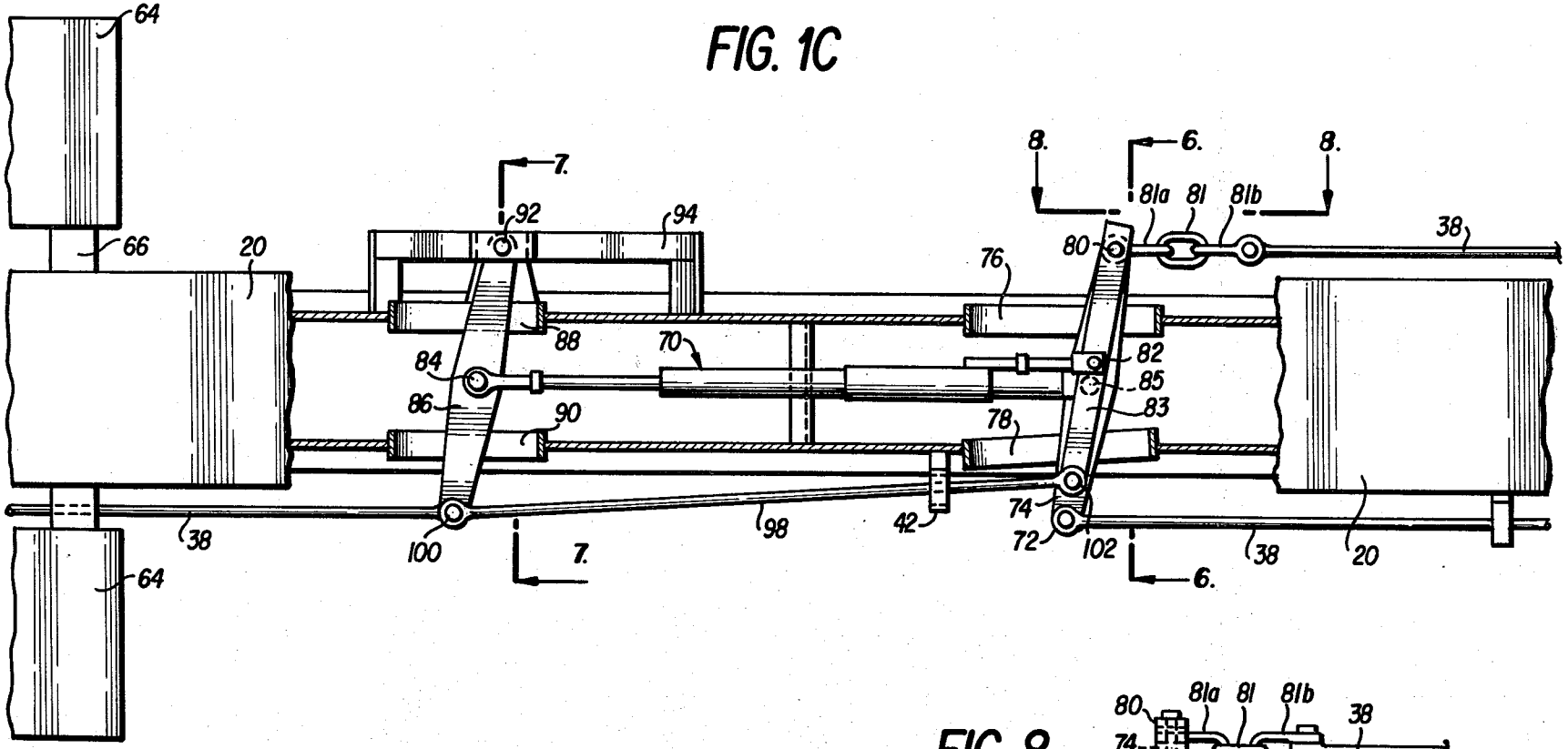
FIG. 1C illustrates in top plan view, partly in section, a center sill showing a conventional automatic slack adjuster to compensate for brake shoe wear and to maintain proper brake shoe clearance.

FIG. 1C illustrates in top plan view the center sill 20 and a conventional automatic slack adjuster to compensate for brake shoe and wheel wear and to maintain proper brake shoe clearance. The automatic slack adjuster is operationally disposed between sections of the brake rod 38 as shown in this figure. The automatic slack adjuster takes up the slack in the brake gear between the actuating end and the brake shoe resulting from wear of the brake shoe and other cooperating parts so that maximum effectiveness of braking can be achieved at all time despite such wear. Conventional devices of this kind are well known and are illustrated in, e.g., the "Car and Locomotive Cyclopedia of American Practice", 2nd Edition, 1970, published by Simmons-Boardman Publishing Corporation, New York City, at pages 696 et seq.

Figure 8:
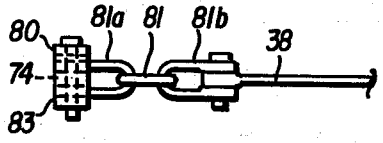
FIG. 8 is a side elevational view of the air brake compressive force isolating link, along the line 8—8 of FIG. 1C.
Figure 6:
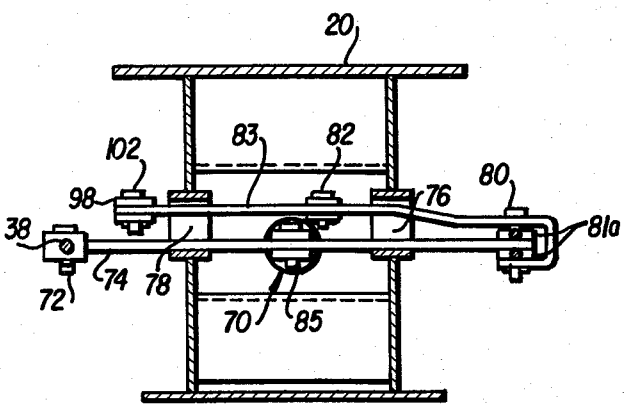
FIG. 6 is a cross-sectional view taken along the line 6—6 of FIG. 1C.

The horizontal handbrake rod is connected by a suitable pin 72 to a transverse horizontal lever 74 that is positioned in openings 76 and 78 provided in the center sill 20. The other end of the lever 74 is connected by a pin 80 to a brake rod 38 on the other side of the center sill 20 which actuates the brakes on the truck to the right of the position shown in FIG. 1C. As shown in FIG. 8, the connection between the upper end (as shown in FIG. 1C) of the horizontal lever 74 and the brake rod 38 is via a compressive force isolating link 81 which is loosely linked between the clevises **81*a* and 81*b* so that the actuation of the handbrake arrangement of the present invention is made independent of the actuation of the conventional train airbrakes. It will be evident that by virtue of the interposition of the loose link 81 only tension forces can be transmitted through the elements 81, 81*a* and 81*b*. One end (a control rod or sensing element) of the automatic slack adjuster 70 is attached by a pin 82 to approximately the center of a companion lever 83 (see FIG. 6) of the lever 74, the other end of the slack adjuster 70 being attached via pin 84 at approximately the center of another transverse horizontal lever 86 extending through openings 88 and 90 in the center sill 20. The upper end of the lever 86 (as viewed in FIG. 1C) is fixed by pin 92 which is attached to the supporting frame 94 secured to the center sill 20 such as by welding, whereby the lever 86 has a fixed fulcrum point at the center of the pin 92. The automatic slack adjuster proper is also attached to approximately the center of lever 74 via pin 85**.

At the bottom of lever 86 (as viewed in FIG. 1C), i.e., the other end of lever 86, a relatively short horizontal rod 98 connects the transverse horizontal levers 86 and 74 via pivot pins 100 and 102, respectively. The rod 98 is supported in bracket 104 attached to the center sill 20 in such fashion that the rod 98 can readily move horizontally and thereby assist in the control function of the automatic slack adjustor. Also pinned via pin 100 to the horizontal lever 86 is the horizontal rod 38 which continues on along the side of the center sill 20 to the left as shown in FIG. 1C. The function of the conventional automatic slack adjuster 70, which is disposed between the two actuating levers 86 and 74, is to automatically compensate for wear between the brake shoe and the car wheels thereby insuring even application of braking throughout the entire series of cars, despite wear with time.

Figure 1D:
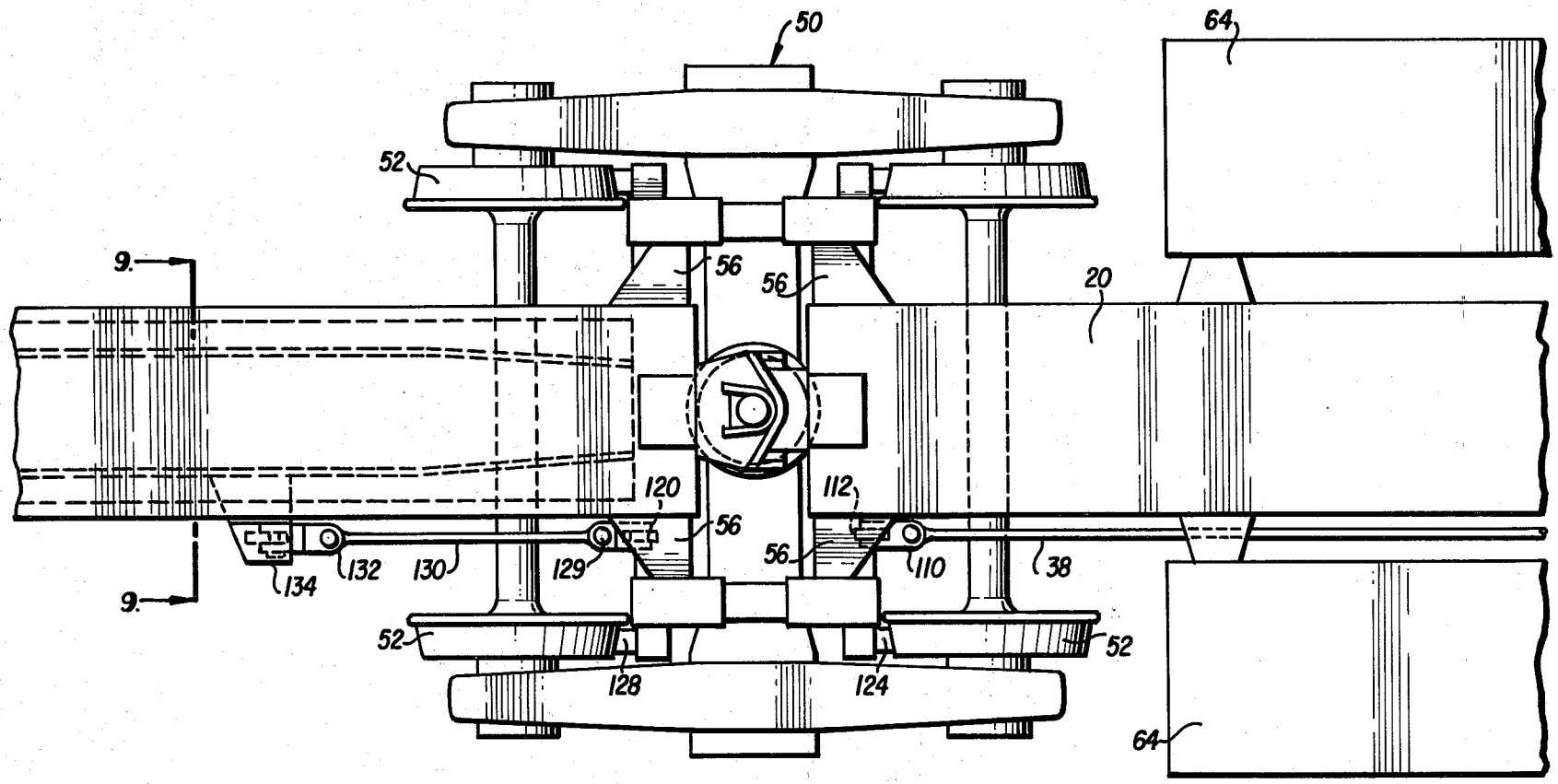
FIG. 1D illustrates in top plan view the final pair of interconnected cars with their brake rod connections, which in this particular instance for purposes of illustration is the fourth truck from the B-end.

FIG. 1D is a top plan view similar to that of FIG. 1B except that in FIG. 1D the last pair of interconnected cars to which the handbrake attachment of the present invention is employed is illustrated.

As shown in FIg. 1D (and also in FIG. 2D which is a side elevational view of FIG. 1D) the brake rod 38 is attached by a pin and clevis arrangement 110 to the top of the brake beam or truck vertical lever 112 for actuating the brake beam and applying the brake shoes against the wheels of the car. The lower end of the brake beam or truck vertical lever 112 is attached via pin 114 to a short rod 116 which in turn is attached via pin 118 to the lower end of a cooperating brake beam or truck vertical lever 120 on the next following car. Attached to the truck vertical lever 112 near its lower end by a pin 122 is a conventional connection to the brake beam-brake shoe combination 124, a similar pin 126 serving to connect a similar brake beam-brake shoe combination 128 near the lower end of the opposing truck vertical lever 120. The upper end of the truck vertical lever 120 is connected by a pin and clevis arrangement 129 to a relatively short rod 130 which by a suitable pin and clevis arrangement 132 is attached to a fixed bracket 134 securely affixed to the center sill 20 to provide a fixed dead lever point to enable actuation of the brake 124 and 128 to be effected.

Figure 2B:
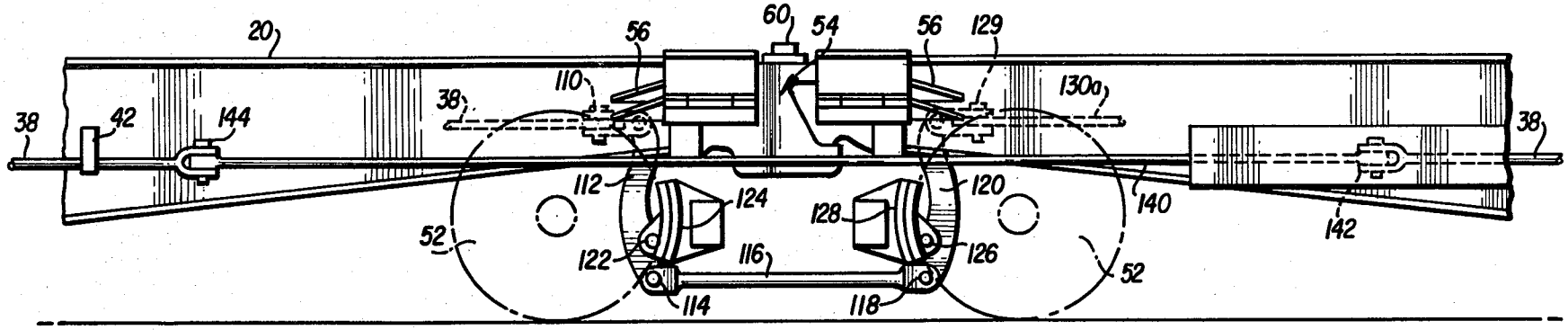
FIG. 2B is a side elevational view of the structure illustrated in FIG. 1B.
Figure 2D:
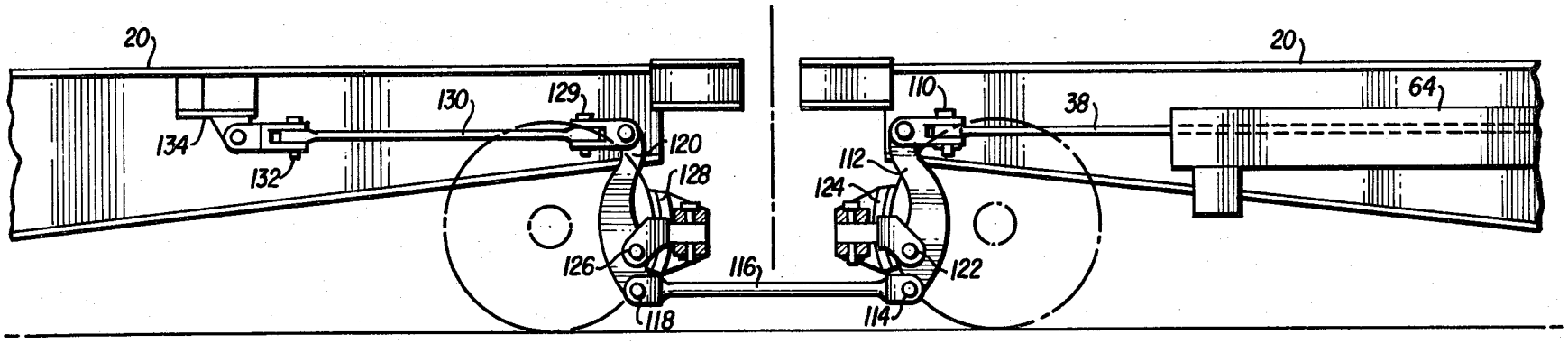
FIG. 2D is a side elevational view of the structure illustrated in FIG. 1D.
Figure 9:
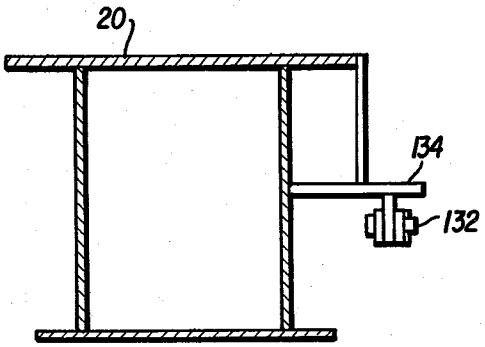
FIG. 9 is a cross-sectional view taken along the line 9—9 of FIG. 1D.
Figure 5:
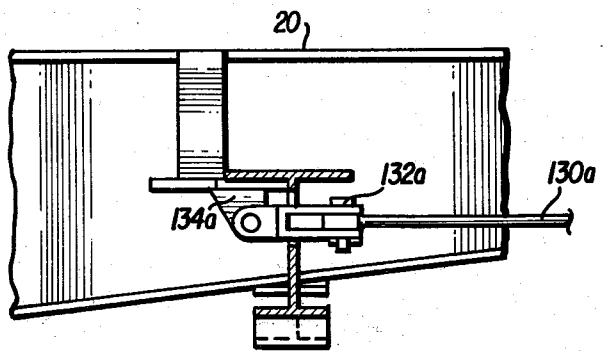
FIG. 5 is a cross-sectional view taken along the line 5—5 of FIG. 1B.

Thus referring to FIG. 2D it will be apparent that upon movement of the brake rod 38 to the right (as shown in that figure) the brake beam-brake shoe combination 124 will be forced against the car wheel 52 and the lower part of the vertical lever 114 will transmit a force to the left (as shown in FIG. 2D) which actuates the truck vertical lever 120 to move the brake beam-brake shoe combination 128 against its wheel 52, the truck vertical lever 120 moving in a clockwise direction about its upper end as a fulcrum point under the constraint of the rod 130, pin 132, and fixed dead lever point 134.

FIG. 2B is a view similar to FIG. 2D except that in FIG. 2B the brake beam-brake shoe actuation is shown on the far side of the center sill, the main brake rod 38 being connected across the gap between the two adjacent cars by a shorter rod 140 and clevises 142 and 144. It will be noted in FIG. 2B (and FIG. 1B) elements 130*a*, 132*a* and 134*a* are similar to and perform the same function as elements 130, 132 and 134 in FIG. 2D.

Figure 10:
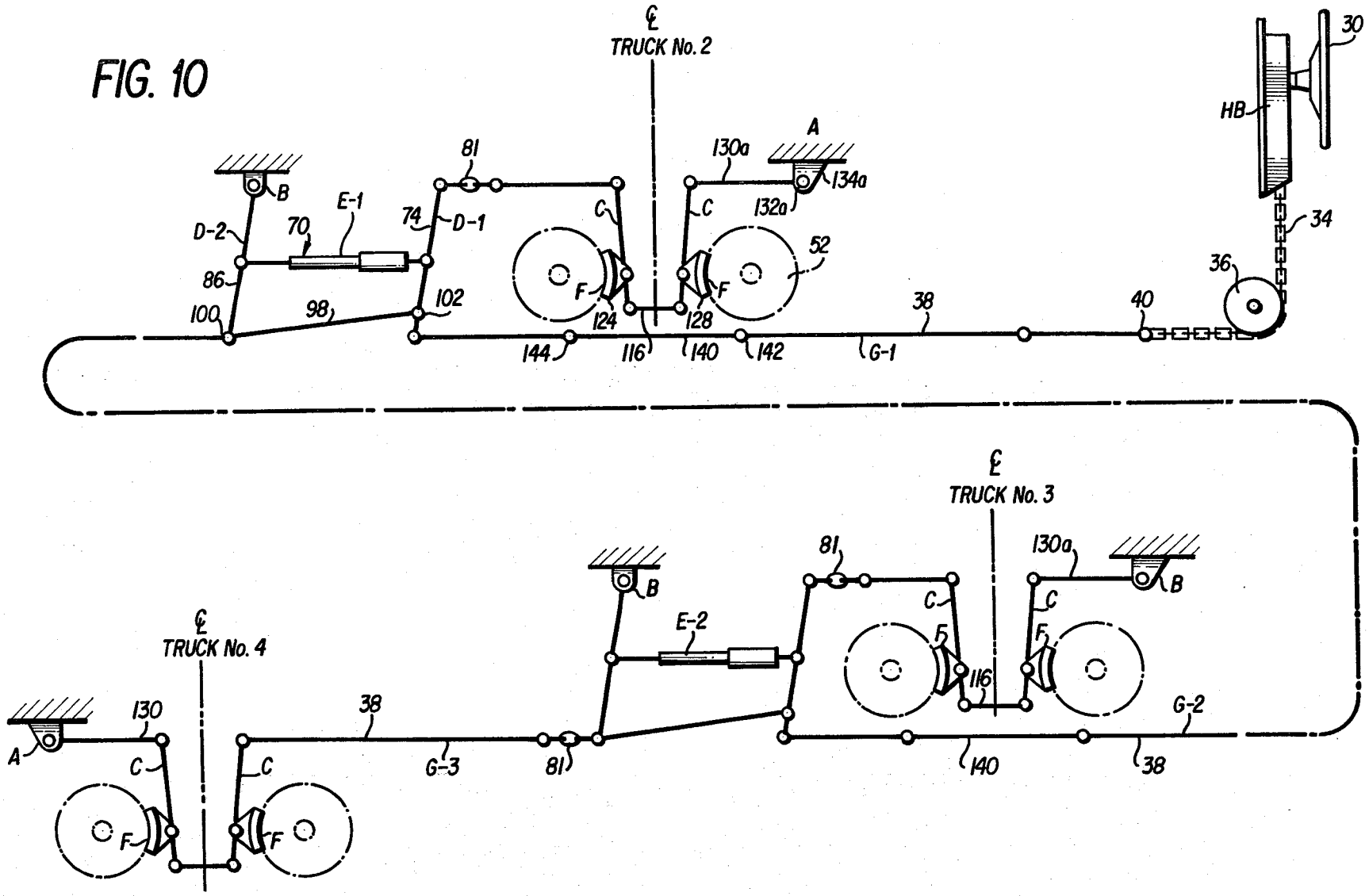
FIG. 10 is a schematic drawing showing the various connections and mode of operation of the entire "train" of rods, levers, etc., by which the actuation of the brakes is effected.

A force diagram of the brake arrangement on the present invention is shown in FIg. 10. In that figure the various letters have the following meanings:

A—Fixed dead lever point;
B—Fixed fulcrum point;
C—Brake beam or truck vertical lever;
D—Horizontal lever through center sill;
E—Connecting Rod--slack adjuster may be used in place of an ordinary rod;
F—Brake shoe on brake beam;
G—Longitudinal (horizontal) handbrake rods;
HB—Handbrake operating mechanism.

As shown by this drawing, the handbrake operating mechanism HB is connected to the brakes on the second, third and fourth trucks from the handbrake end (the B end) of the articulated car. The handbrake take-up chain connects to the horizontal rod through the clevis connection described earlier, the horizontal handbrake rods G1, G2 and G3 running parallel to the center sill on the end unit of the articulated car, passing over the truck No. 2 bolster and connecting to a horizontal lever D1 that passes through the center sill in the second unit from the car end.

The horizontal rod on the opposite side connects to the conventional vertical truck brake vertical lever C already described. This in turn connects to its opposite vertical brake beam C via the lower (horizontal) rod between the vertical brake beams, thus allowing the handbrake to apply braking force to the second truck. when the handbrake is applied, the rod G1 is moved (to the right in FIG. 10) and therefore through the linkages shown forces the brake shoes F against the car wheels, the fixed dead lever point A providing the necessary anchorage to the car itself via the center sill.

The linkage at E1 (which may include the conventional automatic slack adjuster) connects to a second horizontal lever D2 that passes through the car center sill and is attached to a pinned fulcrum point B. Lever D2 transfers the handbrake operating force via the horizontal operating rod G2 that runs parallel to the center sill of the second unit from the end, and which passes over the No. 3 truck bolster and connects to the horizontal lever D3, which is turn passes through the center sill of the third unit. Similar connections as mentioned above for the truck No. 2 bolster provide the braking power for truck No. 3.

As before, the force from the handbrake operating mechanism continues through the arrangement and passes through the rod E2 to the horizontal lever D4 which places the horizontal rod G3 in tension and applies braking power to the truck No. 4.

Similar arrangements could be provided for connecting to truck No. 5 and later trucks if a still greater amount of braking power were required.

As earilier indicated, the rods E1 and E2 are preferably replaced by a conventional brake slack adjusting device to prevent an excess amount of handbrake operating chain take-up when wear is experienced on the brake shoes and the car wheels.

It will be understood that the individual elements are per se old and well known, as shown for example in the 1970 "Car and Locomotive Cyclopedia" cited above. The present invention therefore consists essentially in the novel combination and arrangement of individually old elements in the novel environment described above. It provides an effective handbrake linkage for the purpose indicated that will not be adversely affected by reason of the train negotiating track curves and will remain fully operational when and as needed despite track curvature.

What is claimed is:

1. In an articulated railway car adapted to be coupled into a train, said railway car comprising a series of car units each having a center sill and connected end to end by articulated connectors to form a railway car, a single railway car truck having wheels bridging the gap between each pair of said end to end car units with the said ends mounted thereon, a handbrake arrangement for braking said series of car units comprising (1) brake shoes disposed to be moved against wheels of a plurality of said trucks by a single hand operated mechanism, and to exert braking pressures on the wheels, (2) means for hand initiating a braking force to be transmitted to the brake shoes and (3) means for transmitting the said initiated force to the brake shoes comprising a series of brake rods, levers and linkages including a transverse horizontal lever which extends through openings in said center sills and on each side of the center sill, one end of said horizontal lever being operatively connected to the means for initiating the force and an opposite end of said horizontal lever being operatively connected to the brake shoes, and a compression force isolating link which permits transmission of tension forces only in the connection between the transverse horizontal lever and the brake shoes and which avoids movement of the force transmitting brake rods and levers when the brake shoes are moved by structure other than the hand initiating means.

2. The articulated railway car of claim 1 wherein the brake shoe is supported on a brake beam.

3. A railway car assembly as defined in claim 1, wherein the said force transmission means includes a pair of vertical levers near the center of which is attached a brake beam-brake shoe combination for contacting the car wheels, the other end of the vertical lever being connected to a dead lever point fixed to the center sill.

4. A railway car assembly as defined in claim 1, wherein the horizontal lever extending through the center sill is attached by means of a short connecting rod to a similar horizontal lever extending through the center sill, one end of which is attached to a fulcrum point fixed to the center sill, and the other end of which is connected to a horizontal brake rod for transmitting brake force to succeeding car trucks.

5. A railway car assembly as defined in claim 1, wherein a short horizontal connecting rod is connected at approximately the center of each of the horizontal levers that extend through the center sill.

6. A railway car assembly as defined in claim 5, wherein the short horizontal connecting rod includes a conventional automatic slack adjuster.

7. A hand actuated brake arrangement for an assembly of railway car units connected end to end by articulated connectors to form a series of railway car units acting as a single railway car when coupled in a railway train which may have a power braking system, said hand actuated brake arrangement comprising a hand actuable means for initiating a force, brake shoe assemblies for responding to the said initiated force to exert a braking force against wheels of said trucks, and means for transmitting said initiated force from said force initiating means to said brake shoe assemblies independent of any power braking system and including brake rods with sections thereof spanning the gap between car units.

8. The hand actuated brake arrangement of claim 7 wherein said means for initiating the said force is a hand operated mechanism and said means for transmitting to said initiated force to the brake shoe assemblies comprises a sheave spaced from said operated mechanism, a chain attached to said hand operated mechanism and responsive to operation of the mechanism, said chain extending from said mechanism around said sheave, and connected to a brake rod supported on the center sill and free to move horizontally relative to the center sill when said mechanism is actuated, said brake rod spanning the space between car units and disposed above each brake shoe of the trucks of the car units of the series, and means for connecting the brake rod to each said brake shoe assembly whereby wheels on a plurality of railway trucks of the car units of the series are braked substantially simultaneously when the said hand operated mechanism is operated.

9. An articulated railway car assembly comprising (1) a series of car units connected end to end at their inner ends by an articulated connector, said series terminating in end car units having semi-automatic couplers for coupling the series as a car into a train, said inside ends of said car units connected together with an articulated connector being mounted on a single truck having wheels which bridges the said inside ends of the car units to form an assembly which is adapted to be coupled as a single car into a train of cars having semi-automatic couplers, and (2) a handbrake arrangement for parking the said series of car units as a single car, said handbrake comprising a means for initiating a force, brake shoe assemblies to be moved into contact with wheels of a plurality of said trucks and to press against the wheels to exert braking forces against the wheels in response to the initiated force, and means for transmitting said force to the brake shoe assemblies to exert substantially simultaneous braking forces against the plurality of wheels, said means for transmitting said force comprising a series of rods and levers connected together and to the brake shoe assemblies and to the force initiating means and an automatic slack adjuster in said force transmission means for adjustment to compensate for wear of the brake shoes.

10. In combination, a series of car units connected end-to-end by articulated connectors to form a railway car, a plurality of railway car trucks with wheels positioned one between each pair of car units and supporting adjacent car unit ends, brake means associated with the wheels of a plurality of said trucks including a pair of brake beams at each truck, and hand operable means for simultaneously actuating said brake means associated with at least two of said car trucks including a motion-transmitting linkage extending along the length of the car units a sufficient distance to span said two or more trucks and being movable lengthwise of the car, the brake means of each truck having a motion-transmitting system with interconnected members movable to actuate the brake beams, and a member of each system being connected to said linkage whereby movement of said linkage causes simultaneous actuation of the brake means for said two or more trucks, and each motion-transmitting system includes a member operable in tension to transmit motion when said linkage is moved to actuate the brake means but inoperable to transmit motion in a reverse direction from the brake means to said linkage.

11. An articulated railway car assembly comprising, a series of car units connected end-to-end by articulated connectors, said series terminating in end car units having semi-automatic couplers for coupling the series as a car into a train having a power brake system, said inside ends of said car units connected together with an articulated connector being mounted on a single truck which bridges the said outside ends of the car units to form an assembly which is adapted to be coupled as a single car into a train of cars having semi-automatic couples, and a hand brake arrangement for parking said series of car units as a single car comprising, a plurality of brake shoe assemblies having brake beams associated with wheels of a plurality of said trucks remote from said semi-automatic couplers, a motion-transmitting system associated with each brake shoe assembly including a movable member operatively connected to said brake beams, a force-transmitting system extending lengthwise of said car units including pivotally-connected rods spanning the space between car units, a hand operated mechanism connected to said force-transmitting system for exerting a pull on said force-transmitting system, and said members of the motion-transmitting system being connected into said force-transmitting system at spaced locations whereby a pull on said force-transmitting system simultaneously moves said members and actuates said brake beams to a braking position.

12. An assembly as defined in claim 11 wherein each of said members is pivotally mounted and said pull causes all the members to pivot in the same direction, and means in each motion-transmitting system preventing movement of said members in said direction in response to any movement of the brake beams to a braking position other than by said force-transmitting system.

13. An articulated railway car assembly comprising: a series of car units each having a center sill and connected end-to-end at their inner ends by an articulated connector; a plurality of trucks positioned one between adjacent unit inner ends and with one of said articulated connectors mounted on each of said trucks; brake structure associated with a truck including a pair of brake beams and first and second truck vertical levers associated one with each brake beam, said truck vertical levers being pivotally connected at one of their ends to a connecting rod extending therebetween; brake operating structure responsive to hand actuation for operating said brake beams at first and second trucks through operation of said truck vertical levers of said trucks with the structure at each of the first and second trucks including a transverse horizontal lever extending to opposite sides of a car unit center sill, a linkage including a compression force isolating link extended between one end of the horizontal lever and the other end of the first of said truck vertical levers, a rod extended between the other end of the second truck vertical lever and pivotally connected to a fulcrum point fixed relative to the center sill of a car unit, a second lever pivoted about a fulcrum point fixed relative to a car unit center sill, and a slack adjuster mechanism operatively connected between said transverse horizontal lever and said second lever; said brake structure further including a hand-operable member for initiating a force, means for transmitting said force in tension to the transverse horizontal lever of the first truck including a first brake rod and a chain extending along the center sill with a pivoted section of the brake rod spanning the space between inner ends of adjacent car units, said first brake rod being connected to the other end of the horizontal lever associated with the first truck; motion-transmitting connections from said first brake rod to the second truck including a second brake rod extended from said second lever of the first truck to the transverse horizontal lever at the second truck whereby a force is applied through said brake rods to the truck vertical levers of the first and second trucks at a side of the car unit center sills opposite the side along which the brake rods extend; and a further motion-transmitting connection for operating the brake structure at a third truck including an additional brake rod in line with the aforementioned brake rods and with a compression force isolating link connecting the second lever of the second truck to a first truck vertical lever at the third truck at the same side of the center sill as the last-mentioned brake rod and the second truck vertical lever at the third truck being pivotally-connected through a connecting link to a fulcrum point fixed relative to the adjacent center sill.

14. An articulated railway car assembly comprising: a series of car units each having a center sill and connected end-to-end at their inner ends by an articulated connector; a plurality of trucks positioned one between adjacent unit inner ends and with one of said articulated connectors mounted on each of said trucks; brake structure associated with a plurality of trucks including a pair of brake beams and first and second truck vertical levers associated one with each brake beam, said truck vertical levers being pivotally connected at one of their ends to a connecting rod extending therebetween; brake operating structure responsive to hand actuation for operating said brake beams at first and second trucks through operation of said truck vertical levers of said trucks with the structure at each of the first and second trucks including a transverse horizontal lever extending to opposite sides of a car unit center sill, a linkage including a compression force isolating link extended between one end of the horizontal lever and the other end of the first of said truck vertical levers, a rod extended between the other end of the second truck vertical lever and pivotally connected to a fulcrum point fixed relative to the center sill of a car unit, a second lever pivoted about a fulcrum point fixed relative to a car unit center sill, and a slack adjuster mechanism operatively connected between said transverse horizontal lever and said second lever; said brake structure further including a hand-operable member for initiating a force, means for transmitting said force in tension to the transverse horizontal lever of the first truck including a first brake rod extending along the center sill with a pivoted section spanning the space between inner ends of adjacent car units, said first brake rod being connected to the other end of the horizontal lever associated with the first truck; and motion-transmitting connections from said first brake rod to a second truck including a second brake rod extended from said second lever of the first truck to the transverse horizontal lever at the second truck whereby a force is applied through said brake rods and the transverse horizontal levers to the truck vertical levers of the first and second trucks at a side of the car unit center sills opposite the side along which the brake rods extend.

15. An articulated railway car assembly having structure for hand setting brakes associated with three wheeled trucks comprising: a series of car units each having a center sill and connected end-to-end at their inner ends by an articulated connector; a plurality of trucks positioned one between adjacent unit inner ends and with one of said articulated connectors mounted on each of said trucks; brake structure associated with each truck including a pair of brake beams and first and second truck vertical levers associated one with each brake beam, said truck vertical levers being located at the same side of two of said trucks and on the opposite side of a third truck; brake operating structure responsive to hand actuation for operating said brake beams at two of the three trucks through operation of said truck vertical levers which are at the same side of said trucks with the structure at said two trucks including at transverse horizontal lever extending to opposite sides of a car unit center sill, a linkage including a compression force isolating link extended between one end of the horizontal lever and an end of the first of said truck vertical levers, a rod extended between an end of the second truck vertical lever and pivotally connected to a fulcrum point fixed relative to the center sill of a car unit, a connecting rod pivotally connected to the other ends of said truck vertical levers, a second lever pivoted about a fulcrum point fixed relative to a car unit center sill and extending to opposite sides of the center sill, connecting means between said transverse horizonatl lever and said second lever; said brake structure further including a hand-operable member at an end of a car unit remote from an articulated connection for initiating a force, means for transmitting said force, means for transmitting said force in tension to the transverse horizontal lever of one of the two trucks including a first brake rod extending along the center sill with a pivoted section spanning the space between inner ends of adjacent car units, said first brake rod being connected to the other end of the horizontal lever associated with the first of said two trucks; motion-transmitting connections from said first brake rod to the second of said two trucks including a second brake rod extended from said second lever of the first truck to the transverse hoirzontal lever at the second truck whereby a force is applied through said brake rods to the truck vertical levers of the first and second trucks at a side of the car unit center sills opposite the side along which the brake rods extend; and a further motion-transmitting connection for operating the truck vertical levers at the third truck which are at the same side of a car unit center sill as the brake rods including an additional brake rod in line with the aforementioned brake rods with a compression force isolating link connecting the second lever of the second truck to a first truck vertical lever at the third truck at the same side of the center sill as the last-mentioned brake rod and the second truck vertical lever at the third truck being pivotally connected through a connecting link to a fulcrum point fixed relative to the adjacent center sill.

* * * * *